United States Patent [19]

Kitterman et al.

[11] 3,939,854

[45] Feb. 24, 1976

[54] TRAY WASHING SYSTEM

[76] Inventors: Lawrence Pete Kitterman, 1309 Woodway, Hurst, Tex. 76053; Howard Gene Rice, 1109 Hadrian Court, Irving, Tex. 75060

[22] Filed: Dec. 14, 1973

[21] Appl. No.: 424,685

Related U.S. Application Data

[62] Division of Ser. No. 89,401, Nov. 13, 1970, Pat. No. 3,798,065.

[52] U.S. Cl. ..... 134/57 R; 134/72; 198/284

[51] Int. Cl.[2] ..... B08B 3/00

[58] Field of Search ..... 198/267, 282, 284, 285; 214/1 Q; 134/57 R, 72

[56] References Cited

UNITED STATES PATENTS 3,034,632 4/1962 Wampler ..... 198/284

*Primary Examiner*—Frank E. Werner

*Attorney, Agent, or Firm*—Richards, Harris & Medlock

[57] ABSTRACT

A tray washing system includes conveyors which transport compartmented food service trays from a tray receiving mechanism to inverting and scrapping mechanisms and through washing, rinsing and drying mechanisms to a stacking mechanism. The receiving mechanism restricts trays to insertion in a predetermined orientation in which the food receiving surfaces face upwardly, and the inverting mechanism inverts each tray so that the food receiving surface faces downwardly. As each tray is inverted, the scrapping mechanism discharges substantially the entire contents of a cleaning fluid reservoir onto the food receiving surface of the tray, and thereby dislodges refuse and silverware that may be on the tray. The washing, rinsing and drying mechanism apply a water-detergent solution, rinse water, and drying air to the trays, respectively, and the stacking mechanism deposits the trays onto a mobile self-depressing tray receiver. The tray washing system further includes a silverware separating and soaking mechanism comprising a chute which receives cleaning fluid and refuse and silverware entrained therein, a dam which removes the heavier silverware from the cleaning fluid, and a door in the bottom of the chute for dropping the silverware into a soaking sink.

4 Claims, 13 Drawing Figures

TRAY WASHING SYSTEM

This is a division of application Ser. No. 89,401, filed Nov. 13, 1970, now U.S. Pat. No. 3,798,065.

BACKGROUND AND SUMMARY OF THE INVENTION

This invention relates to a tray washing system, and more particularly to a fully automated system for cleaning compartmented food service trays.

Various institutions, particularly elementary schools, now serve lunches and other meals on compartmented food service trays, rather than on conventional tableware, such as dinner plates, salad plates, sauce dishes, etc. This is advantageous in that when compartmented food service trays are employed, the purchasing, stocking, distributing, collecting and washing of ware is reduced to a single item. Also, small children are considerably more adept at handling a compartmented food service tray than they are at handling the numerous tableware items that must be used when a meal is served in the conventional manner.

The main disadvantage that has been experienced in the use of compartmented food service trays relates to the human effort involved in washing the trays after each meal. At the present time, tray washing includes manually scraping each tray, manually loading each tray into a dishwashing machine, and to subsequently manually unloading each tray from the machine. Because conventional dishwashing machines are not designed for use with compartmented food service trays, it is often necessary to manually inspect each tray after washing, and to re-wash many of the trays. At today's labor rates, any system involving so much manual labor can be prohibitively expensive. Also, due to social connotations, it is often impossible to hire "dishwashers," even though good salaries are offered.

One approach to solving the foregoing problem involves the use of disposable compartmented food service trays. In order to reduce volume of material involved, machines for shreading and/or compacting disposable trays and the food and paper refuse associated therewith have been proposed. Unfortunately, the use of presently available disposable compartmented food service trays is not wholly satisfactory. For example, it costs more to purchase disposable compartmented food service trays than to wash conventional, permanent-type compartmented food service trays, so that no real savings are realized. Also, when a shreading and/or compacting machine is employed, the use of compartmented food service trays necessitates the handling of a great volume of refuse. Perhaps most importantly, presently available disposable compartmented food service trays are flimsy in construction and unappetizing in appearance, and are therefore unsatisfactory to students, dieticians and educators.

The present invention comprises a fully automated compartmented food service tray cleaning system. In accordance with the preferred embodiment of the invention, trays are moved in timed sequence to a mechanism that pours a cleaning fluid over each tray and thereby removes refuse and silverware from the tray. Thereafter, the trays are moved through washing, rinsing and drying stations to a mechanism that automatically deposits the trays on a mobile self-depressing tray receiver. Preferably, each tray is loaded into the system by the person who has used the tray so that all the manual labor that has heretofore been necessary in the washing of compartmented food service trays is completely eliminated.

DESCRIPTION OF THE DRAWINGS

A more complete understanding of the invention may be had by referring to the following Detailed Description when taken in conjunction with the drawings, wherein.

DETAILED DESCRIPTION

Figures 1, 2:
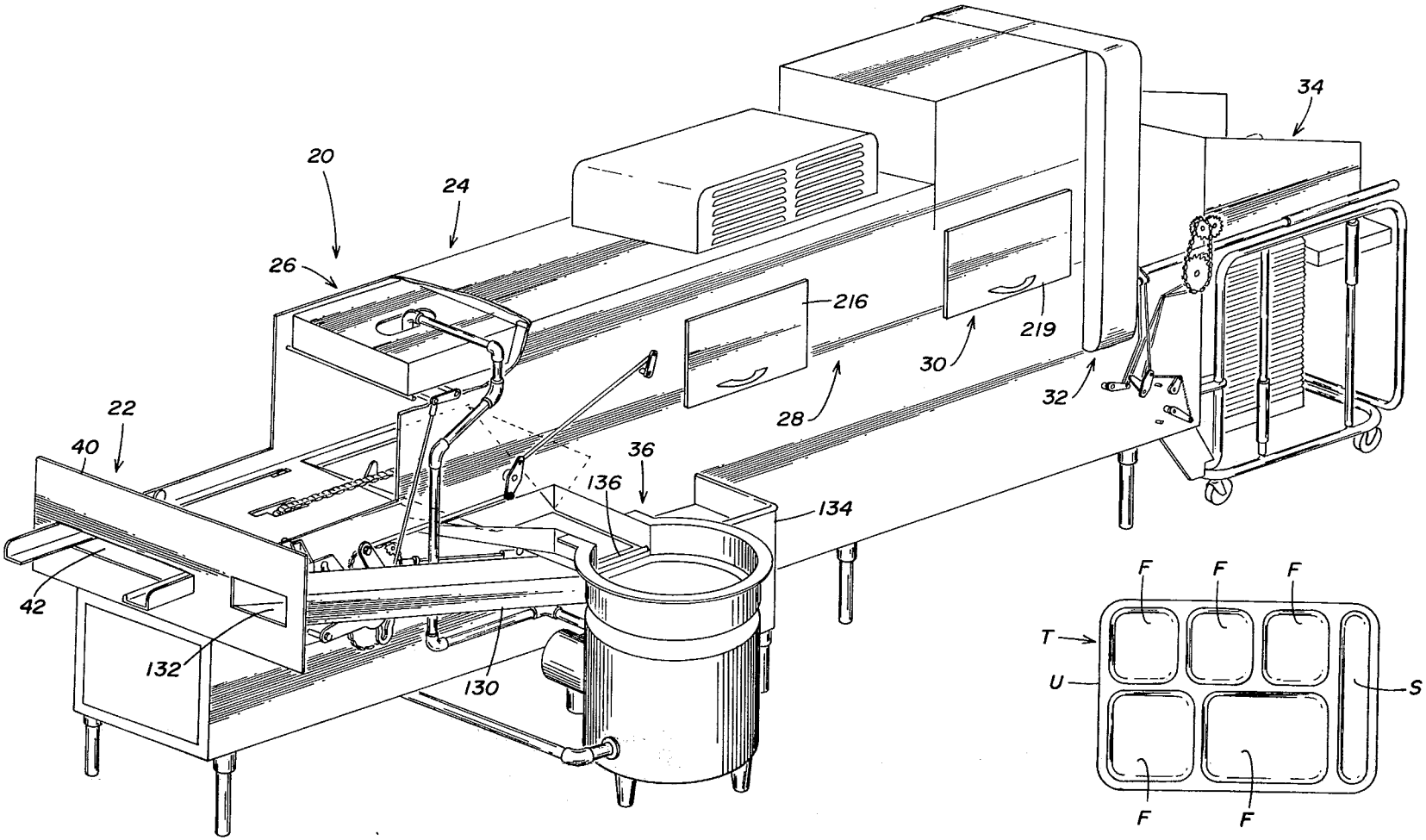
FIG. 1 is a top view of a compartmented food service tray.
FIG. 2 is a perspective view of a tray washing system employing the present invention.

Referring now to the drawings, and particularly to FIG. 1 thereof, a compartmented food service tray T is shown. The tray T is preferably formed from a durable material that is capable of withstanding repeated washings, such as plastic, fiberglass, or metal. The upper surface U of the tray T comprises a food receiving surface that is divided into a number of food receiving compartments F and a silverware receiving compartment S. It will be understood that the tray T actually comprises a sheet of uniform thickness, and that the compartment F and S comprise depressions formed in the sheet, so that a groove extends between the silverware compartment S and the remainder of the tray T.

Compartmented food service trays of the type shown in FIG. 1 are used in elementary schools to serve school lunches. Typically, a quantity of trays sufficient in number to serve all of the students is delivered to one or more serving stations. At the serving stations, various food items are deposited directly on the food receiving surface of each tray, and the tray is then delivered to a student. The student also receives various pieces of silverware and additional food items, such as a beverage and a dessert. It will be understood that the latter items are normally distributed in individual cartons or containers.

After receiving his tray, each student carries the tray to a table, where the lunch is eaten. Upon completion of the meal, the students carry the trays to a refuse disposal area where paper refuse, i.e., milk cartons, straws, napkins, etc., from the meal is deposited in trash containers. Then, the students deposit the trays for cleaning with all refuse from the meal still on the tray, and simultaneously deposit silverware in a chute that leads to a silverware soaking sink. It will be understood that since the lunch was served directly on the upper surface of the trays in the food receiving compartments thereof, the trays must be scrapped, thoroughly washed and sterilized before they can be returned to the start of the cafeteria line for use in the next meal.

Referring now to FIG. 2, a tray washing system 20 employing the present invention is shown. The system 20 is adapted to automatically clean compartmented food service trays of the type shown in FIG. 1, and comprises: a tray receiving mechanism 22; a tray inverting mechanism 24; a scrapping mechanism 26; washing, rinsing and drying mechanisms 28, 30 and 32; and a tray stacking mechanism 34. The tray washing system 20 further includes a silverware separating and soaking mechanism 36.

Figure 3:
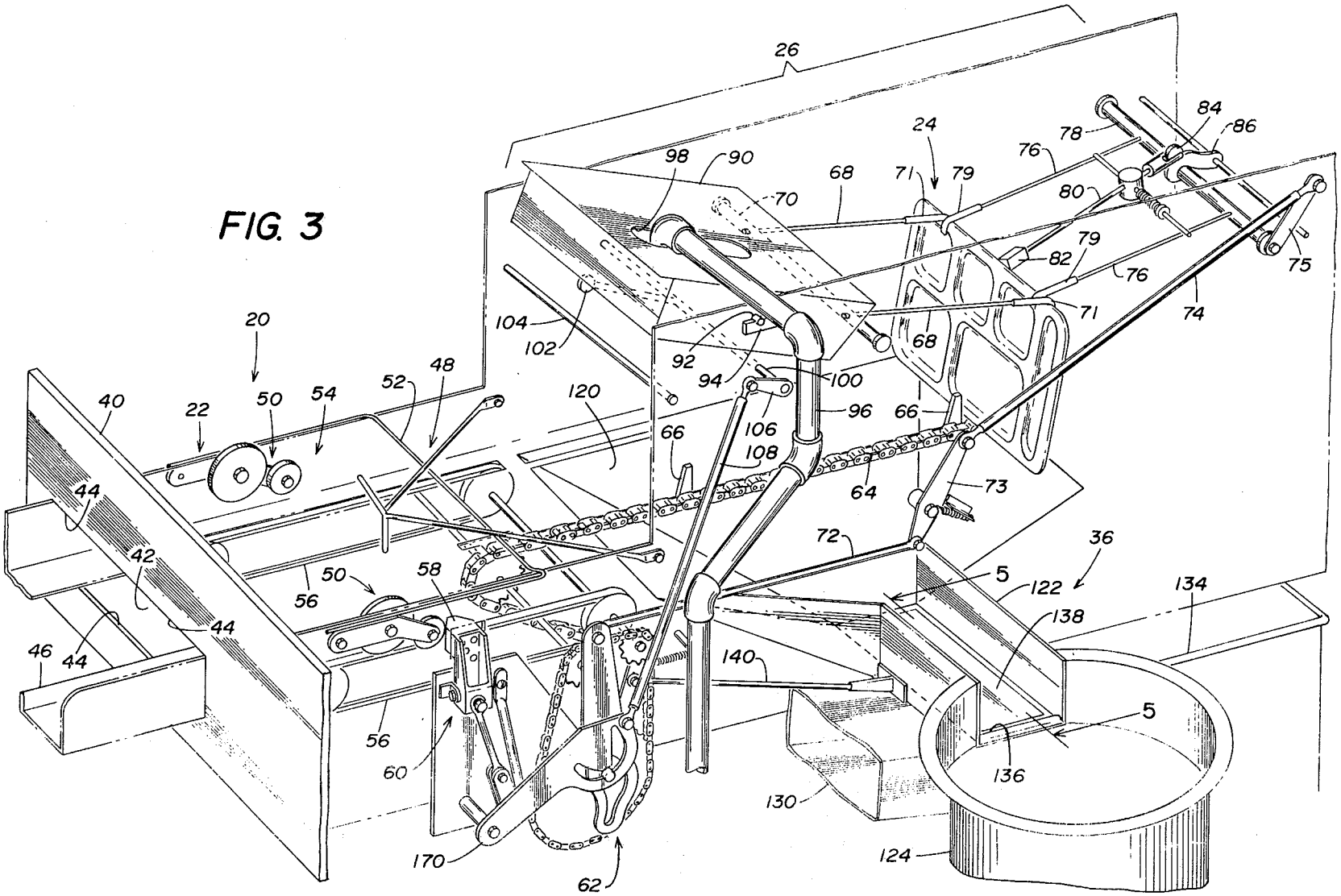
FIG. 3 is an enlarged perspective view of the tray receiving, tray inverting, scrapping, and silverware separating and soaking mechanisms of the tray washing system shown in FIG. 1.

The structural details of the tray receiving, tray inverting, scrapping, and silverware separating and soaking mechanisms of the tray washing system 20 are best shown in FIG. 3, wherein the functional components of the tray washing system are shown in full lines and the housing and other non-functional components are shown in phantom lines. The tray receiving mechanism 22 includes a plate 40 which may comprise a portion of a wall separating a school lunch room from a school kitchen. The plate 40 has a passageway 42 formed in it through which compartmented food service trays are inserted into the tray washing system 20 by the users of the trays. The edges of the plate 40 define the passageway 42 and include spaced pairs of opposed surfaces 44 which prevent the insertion of two stacked trays through the passageway 42. An upstanding ridge 46 formed in the bottom of the passageway 42 receives the groove between the silverware compartment and the food compartments of each tray, and thereby prevents the insertion of the trays other than with the silverware compartment positioned to the right and the food receiving surface facing upwardly.

A tray blocking member 48 is pivotally supported on the tray washing system 20 just beyond the passageway 42 in the plate 40. The tray blocking member 48 is normally positioned in the path of trays inserted through the passageway 42, and therefore prevents the insertion of trays in an endwise orientation. Two pairs of rollers 50 are pivotally supported at the opposite sides of the tray washing system 20 and are interconnected by a bar 52 that extends under the tray blocking member 48. The rollers 50 cooperate with the surface 44 of the plate 40 to prevent the insertion of two stacked trays. Also, a properly inserted compartmented food service tray engages the rollers 50 and pivots the rollers upwardly. This action pivots the bar 52 upwardly, which in turn pivots the blocking member 48 upwardly, out of the path of the tray. The pair of rollers 50 are arranged to maintain the blocking member 48 out of the path of a properly inserted tray until the tray clears the blocking member 48.

From the foregoing, it will be understood that the passageway 42, the ridge 46, and the tray blocking member 48 cooperate to constrain trays inserted into the tray washing system to a predetermined orientation. Properly oriented trays inserted through the passageway 42 are engaged with a conveyor 54 comprising a pair of V-belts 56 by the rollers 50. The V-belts advance each tray into engagement with a triangularly shaped spacer member 58 comprising a portion of a tray timing mechanism 60. The spacer member 58 is normally positioned in the path of trays entering the tray washing system 20, and therefore normally prevents the movement of the trays into the tray washing system 20 under the action of the conveyor 54. At a predetermined point in each operating cycle of the tray washing system 20, a drive mechanism 62 actuates the timing mechanism 60 to pivot the spacer 58 out of the path of the trays, whereupon the conveyor 54 advances one tray into the tray washing system 20. By this means, the timing mechanism 60 assures a predetermined spacing between compartmented food service trays passing through the tray washing system 20. Because of its triangular shape, the spacer 58 enters the space between trays inserted sequentially through the passageway 42, and thereby prevents the insertion of trays other than at the proper point in the cycle of operation of the tray washing system.

Upon release by the timing mechanism 60, each tray is transported by the conveyor 54 to the end of the V-belts 56, whereupon it is engaged by a pin-type conveyor 64. The conveyor 54 includes a plurality of pins 66 spaced to receive trays from the conveyors 54 and to transport each tray entering the tray washing system 20 from the receiving mechanism 22 through the tray inverting mechanism 24. During this movement, the tray inverting mechanism 24 inverts each tray from its initial orientation wherein its food receiving surface faces upwardly to an orientation wherein the food receiving surface of the tray faces downwardly.

The tray inverting mechanism 24 includes a first pair of arms 68 which are supported for pivotal movement about the axis of a shaft 70 under the action of gravity. As the tray moves through the tray washing system 20 under the action of the pin-type conveyor 64, a pair of hooks 71 formed on the ends of the arms 68 engage the forward edge of the tray, whereupon the arms 68 cooperate with the conveyor 64 to pivot the tray into a vertical orientation. As the tray approaches the vertical orientation, the drive mechanism 62 operates through a rod 72, a lever 73, a rod 74 and a lever 75 to pivot a second pair of arms 76 about the axis of a shaft 78. This action engages a pair of hooks 79 formed on the ends of the arms 76 with the same edge of the tray that is engaged by the arms 68, whereupon the arms 76 pivot the tray from the vertical orientation to a horizontal orientation in which the food receiving surface of the tray faces downwardly.

The tray inverting mechanism 24 further includes an arm 80 mounted for pivotal movement with the arms 76. A tray engaging member 82 is secured to one end of the arm 80 and a roller 84 is secured to the other end. As the arm 80 pivots downwardly with the arms 76, the roller 84 follows the upper surface of the cam 86 and cooperates with the cam 86 to urge the tray engaging member 82 outwardly. This action grips the tray between the tray engaging member 82 and the hooks 79 of the arms 76.

Figure 4:
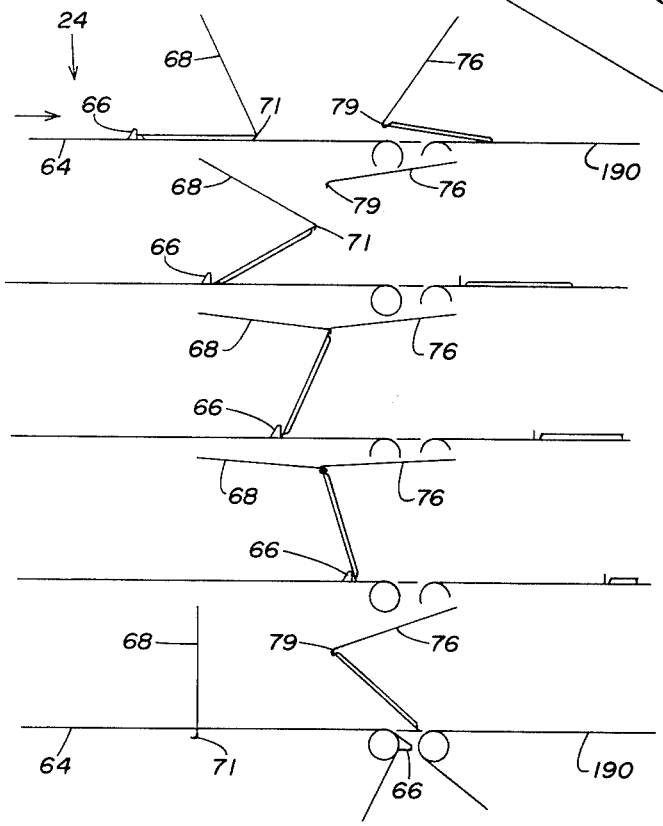
FIG. 4 is a schematic illustration showing various steps in the operation of the tray inverting mechanism.

The functions of the various components of the tray inversion mechanism 24 of the tray washing system 20 will be better understood by referring to FIG. 4, wherein various steps in the operation of the tray inverting mechanism 24 are schematically illustrated. As a compartmented food service tray is moved through the tray washing system 20 by the pin-type conveyor 64, it is engaged by the hooks 71 of the first pair of arms 68. Further forward motion of the tray under the action of the conveyor 64 causes the forward end of the tray to pivot upwardly about the axis of the shaft 70.

As the tray reaches a substantially vertical orientation, the drive mechanism 62 pivots the hooks 79 of the arms 76 into engagement with the same edge of the tray that is engaged by the arms 68. Upon further movement of the tray by the conveyor 64, the tray moves over center, whereupon the arms 68 drop out of engagement with the tray under the action of gravity. Then, the arms 76 complete the inversion of the tray. It should be noted that during the latter portion of the tray inversion process, the arms 76 push the tray forwardly to a point beyond the forward end of the conveyor 64.

Referring again to FIG. 3, the scrapping mechanism 26 of the tray washing system 20 includes a cleaning fluid reservoir 90 that is pivotally supported by a pair of trunnions 92 and a pair of yokes 94. A pipe 96 extends into the reservoir 90 through an elongated slot 98 formed in the upper surface thereof, and a cleaning fluid is continuously supplied to the reservoir 90 through the pipe 96. A pivotally supported shaft 100 extends under the reservoir 90 and an arm 102 extends perpendicularly from the shaft 100. Normally, the reservoir 90 is maintained in a retracted position wherein the reservoir 90 rests on the arm 102, and the arm 102 rests on a stationary shaft 104.

The shaft 100 is connected to the drive mechanism 62 through a bell crank 106 and a rod 108. As each tray passing through the tray washing system 20 is manipulated into a substantially vertical orientation by the tray inversion mechanism 24, the drive mechanism 62 moves the rod 108 upwardly. The action pivots the arm 102 upwardly about the axis of the shaft 100, and therefore tilts the reservoir 90 about the trunnions 92 from the position shown in FIG. 2 to the position shown in FIG. 3. During the tilting of the reservoir 90, cleaning fluid pours out of the reservoir onto the food receiving surface of the tray. This action "scraps" the tray, that is, the cleaning fluid flowing out of the reservoir 90 dislodges refuse and any silverware that may be on the tray. It has been found that the scrapping action of the present invention is superior to that of prior tableware cleaning systems in that by dumping substantially the entire contents of the reservoir 90 onto the food receiving surface of each tray passing through the tray washing system 20, the removal of all refuse and silverware from each tray is virtually assured, due to the weight and even distribution of the cleaning fluid flowing across the food receiving surface of the tray.

Cleaning fluid flowing over the food receiving surface of a tray from the reservoir 90 entrains refuse and any silverware that may be on the food receiving surface, and carries the refuse and silverware into a hopper 120. From the hopper 120, the cleaning fluid and the refuse and silverware entrained therein flow into the chute 122, and through the chute 122 into a refuse receiving mechanism 124. The refuse receiving mechanism 124 is conventional in design and operates to separate refuse dislodged by the scrapping mechanism 26 from the cleaning fluid employed in the scrapping mechanism. In accordance with the preferred embodiment of the invention, the cleaning fluid from the refuse receiving mechanism 124 is reused in the scrapping mechanism 26, that is, cleaning fluid from the refuse receiving mechanism 124 is returned to the reservoir 90 through the pipe 96.

Figure 5:
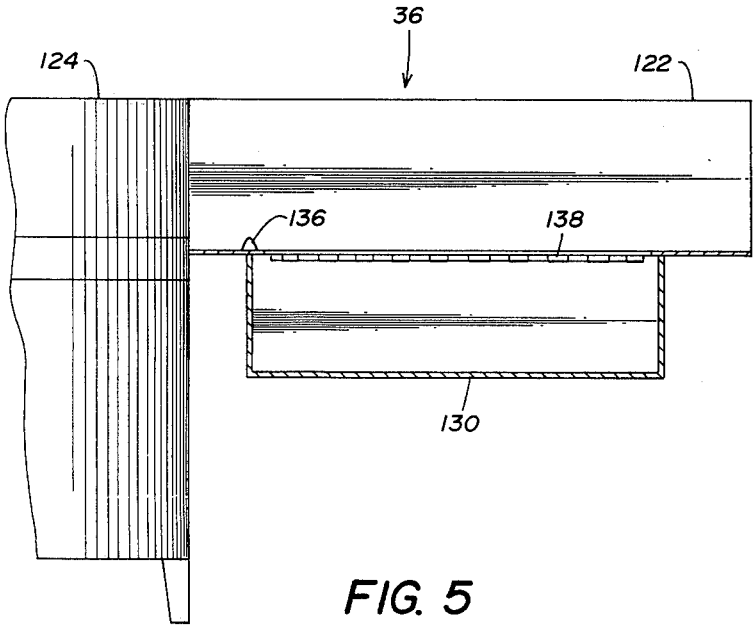
FIG. 5 is a sectional view taken generally along the line 5—5 in FIG. 3 in the direction of the arrows.

As is best shown in FIG. 2, the silverware separating and soaking mechanism 36 of the tray washing system 20 includes a silverware chute 130 that slopes downwardly from a silverware receiving passageway 132 formed in the plate 40 to a silverware soaking sink 134 which includes a removable silverware collecting basket (not shown). Preferably, all silverware is removed from each tray and is inserted into the silverware separating mechanism 36 through the passageway 132 before the tray is inserted through the passageway 42. It will be appreciated, however, that elementary students will often neglect to remove silverware from their trays before inserting the trays into the passageway 42. To this end, the chute 122 is provided with a dam 136 which disentrains silverware from the cleaning fluid employed in the scrapping mechanism 26 as the cleaning fluid flows through the chute 122. As is best shown in FIG. 5, the dam 136 is positioned in the bottom of the chute 122 at the end thereof adjacent the refuse receiving mechanism 124. During the flow of cleaning fluid and refuse and silverware entrained therein through the chute 122, the dam 136 engages the heavier silverware and restrains the silverware from further movement through the chute 122, while at the same time permitting the cleaning fluid and refuse to flow out of the chute 122 and into the refuse receiving mechanism 124. It will be understood that by providing a chute of proper length and inclination, it is possible to disentrain silverware from cleaning fluid without providing a dam, per se.

As is best shown in FIG. 3, the silverware separating and soaking mechanism 36 further includes a normally closed trapdoor 138 that is connected to the drive mechanism 62 through a link 140. At a point in a cycle of the tray washing system 20 when little or no cleaning fluid is flowing through the chute 122, the drive mechanism 62 opens the trapdoor 138. As is best shown in FIG. 5, the trapdoor 138 is positioned directly above the silverware chute 130. Thus, any silverware that enters the tray washing system 20 on a compartmented food service tray is entrained in cleaning fluid by the scrapping mechanism 26, and is thereafter disentrained from the cleaning fluid by the dam 136, and is finally deposited in the chute 130 by the trapdoor 138. Once the silverware enters the chute 130, it enters the silverware soaking sink 134 in the same manner as if it had been inserted into the chute 130 through the silverware passageway 132.

Figure 6:
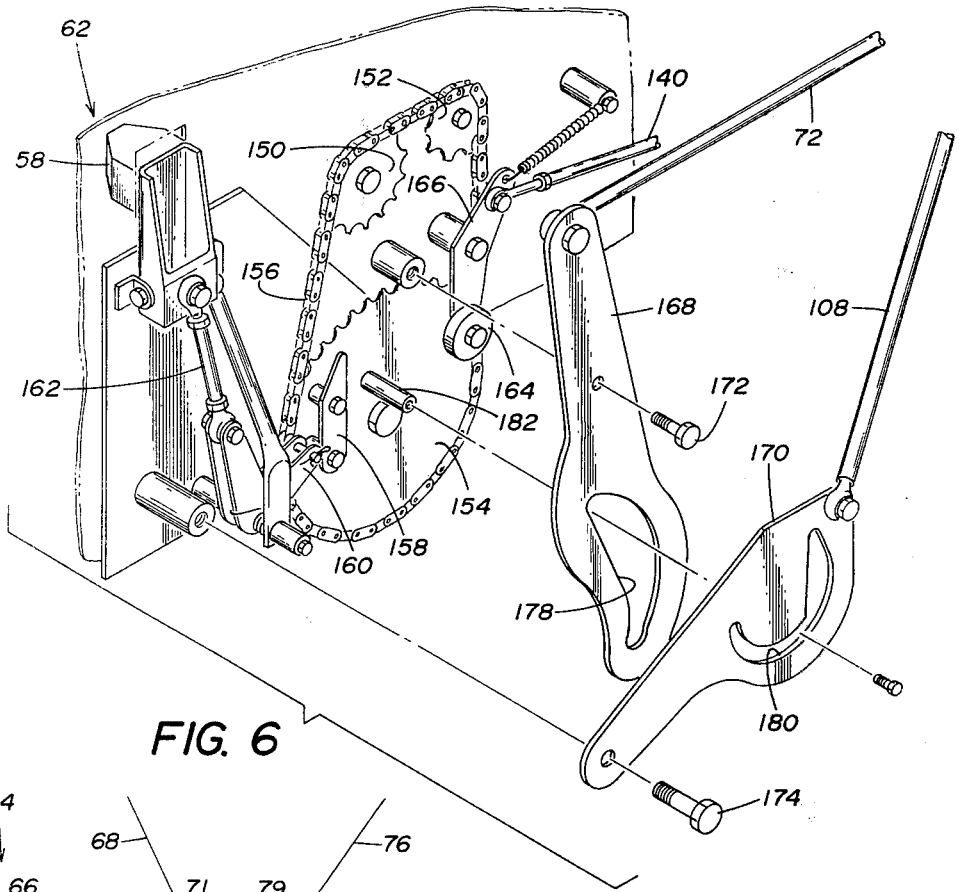
FIG. 6 is an exploded view of the drive mechanism of the tray receiving, tray inverting, scrapping mechanism and silverware separating and soaking mechanisms.

Referring now to FIG. 6, the construction of the drive mechanism 62 of the tray washing system 20 is shown in detail. The drive mechanism 62 includes a sprocket 150 that is continuously rotated by the motor (not shown). The sprocket 150 drives a sprocket 152 and a large sprocket 154 through a chain 156. A cam 158 is mounted on the sprocket 154 for rotation thereby. Once during each revolution of the sprocket 154, the cam 158 engages a bell crank 160 which is connected to the tray spacer member 58 by a link 162. The cam 158, the bell crank 160, the link 162 and the spacer 58 are so arranged that upon engagement of the cam 158 with the bell crank 160, the spacer 58 is pivoted out of the path of trays inserted into the tray washing mechanism 20 through the passageway 42.

Somewhat later during each revolution of the sprocket 154, the cam 158 engages a roller 164 that is mounted on a pivotally supported lever 166. The lever 166 is connected through the link 140 to the trapdoor 138 of the silverware separating and soaking mechanism 36 so that, upon rotation of the gear 150, the cam 158 actuates the trapdoor 138 of the silverware separating mechanism 38. Thus, upon rotation of the sprocket 154, the cam 158 actuates both the spacer 58 and the trapdoor 138 at the proper point in each operating cycle of the tray washing system 20.

The drive mechanism 62 further includes a pair of cams 168 and 170, which are connected to the rod 72 of the tray inverting mechanism 24 and the rod 108 of the scrapping mechanism 26, respectively. The cams 168 and 170 are pivotally supported on a pair of bolts 172 and 174, respectively, and have camming slots 178 and 180 formed through them. The slots 178 and 180 receive a drive pin 182 mounted on the sprocket 154 and, accordingly, upon rotation of the sprocket 154, the drive pin 182 oscillates the cams 168 and 170 to provide the motions necessary for the operation of the tray inverting mechanism 24 and the scrapping mechanism 26.

Figure 7:
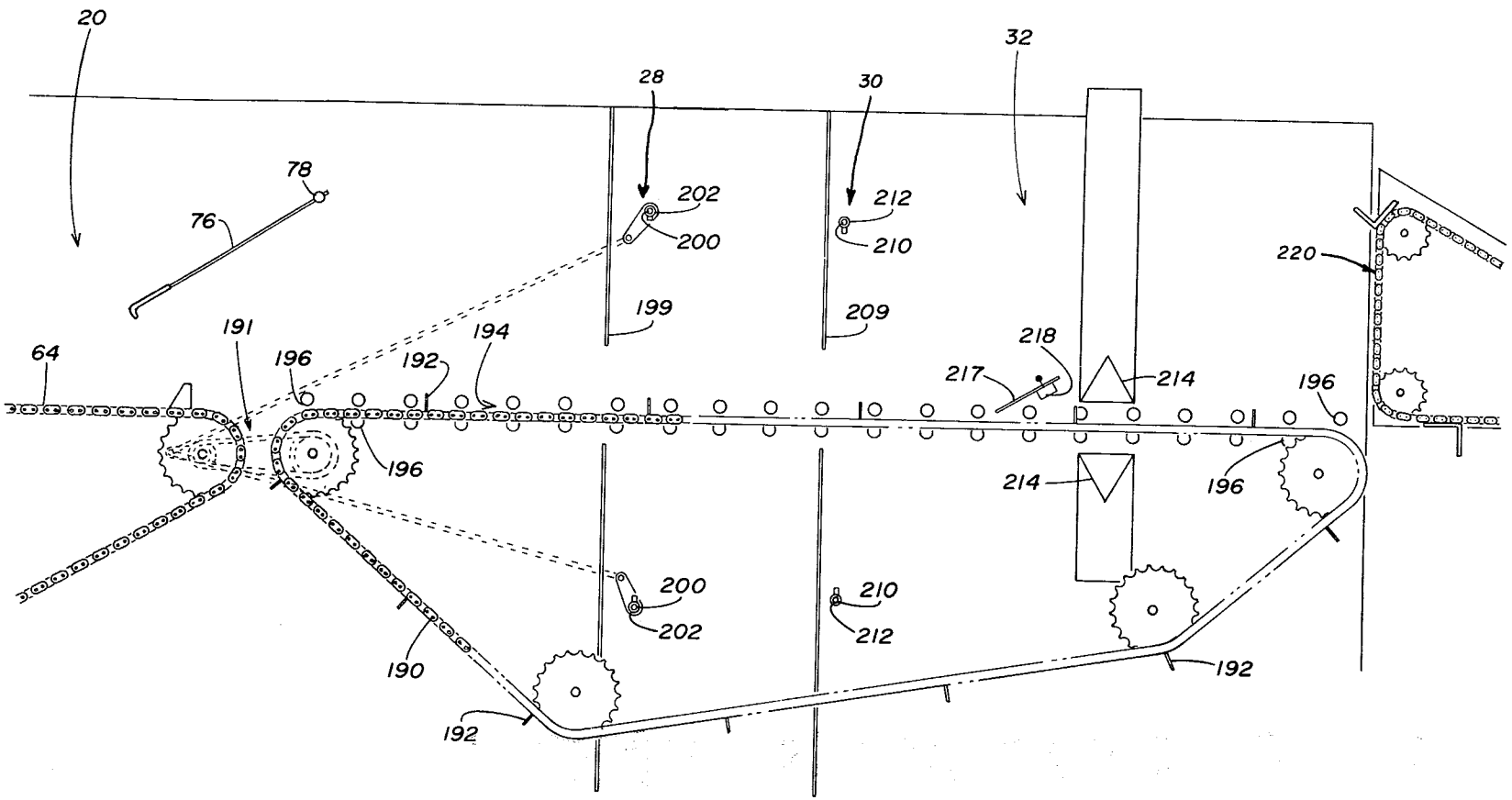
FIG. 7 is a longitudinal sectional view of the tray washing system showing the tray washing, rinsing and drying mechanisms thereof.

Referring now to FIG. 7, the conveyor 64 of the tray washing system 20 drives a pin-type conveyor 190 through a chain and sprocket drive mechanism 191. Each tray passing through the tray washing system 20 is transported by the conveyor 64 and arms 76 into engagement with the conveyor 190, and is thereafter engaged by a pin 192 projecting from the conveyor 190 for transportation along a path 194 defined by a plurality of pairs of opposed rollers 196. The path 194 extends through the washing mechanism 28, the rinsing mechanism 30, and the drying mechanism 32 of the tray washing system 20, and accordingly, each tray passing through the tray washing system is sequentially washed, rinsed and dried as it is transported by the conveyor 190.

Figure 8:
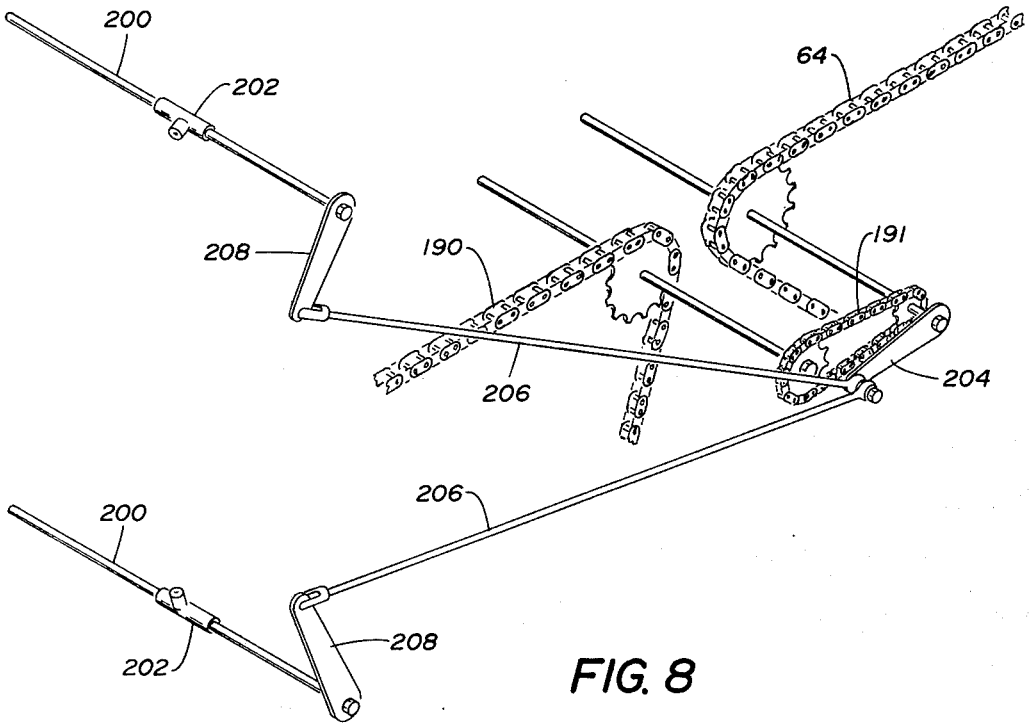
FIG. 8 is a perspective view illustrating the operation of certain portions of the tray washing, rinsing and drying mechanisms shown in FIG. 7.

The washing mechanism 28 of the tray washing system 20 is separated from the scrapping mechanism 26 by a baffle 199 and includes a pair of pipes 200 positioned on opposite sides of the path 194 defined by the opposed rollers 196. In use, a washing fluid, which may comprise a solution of hot water and a suitable detergent or any other suitable washing fluid is directed into the pipes 200 and is discharged from the pipes through a plurality of spray heads 202 mounted thereon. As is best shown in FIG. 8, the pipes 200 are connected to a lever 204 by a pair of links 206 and a pair of levers 208. The lever 204 is mounted for rotation by the conveyor 64, and the links 206 and the levers 208 are arranged to oscillate the spray heads 202 upon rotation of the lever 204. By this means, contact between washing fluid discharged from the spray heads 202 and all portions of each tray passing through the tray washing mechanism 20 is assured.

Referring again to FIG. 7, the rinsing mechanism 30 of the tray washing system 20 is separated from the washing mechanism by a baffle 209 and comprises a pair of pipes 210 positioned on opposite sides of the path 194 defined by the opposed rollers 196. In use, a rinsing fluid, which preferably comprises extremely hot water, is directed into the pipes 210 and is discharged from the pipes through spray heads 212 mounted thereon. Rinsing fluid from the pipes 210 engages the trays passing through the tray washing system 20 under the action of the conveyor 190, and thereby clears the trays of washing fluid that was applied to the trays by the washing mechanism 28.

The drying mechanism 32 comprises a pair of triangularly shaped ducts 214 positioned on opposite sides of the path 194 defined by the rollers 196. The ducts 214 direct a drying fluid across the trays passing through the tray washing system 20, and thereby strip the trays of the rinsing mechanism 30. The drying fluid preferably comprises high velocity air, which may be heated, depending upon the temperature of the rinsing fluid, and the nature of the trays.

From the foregoing, it will be understood that after all of the compartmented food service trays used in a particular meal have been washed by the tray washing system 20, all of the silverware that was used in the meal is located in the silverware soaking sink 134. In accordance with the preferred embodiment of the invention, the silverware is removed from the sink 134 and is placed in a specially designed silverware washing rack (not shown). The rack is then positioned in the tray washing system 20 through a door 216, and is thereafter transported through the washing mechanism 28, and the rinsing mechanism 30. During this action the mechanisms 28 and 30 apply the washing fluid and the rinsing fluid to the silverware, respectively, so that the silverware is thoroughly cleaned and sanitized.

In use, the specially designed silverware rack is positioned on two of the upper rollers of the pairs of opposed rollers 192 and is transported through the mechanism 28 and 30 by the conveyor 190. After passing through the mechanism 30, the rack moves up a ramp 217 and into engagement with a switch 218, which upon actuation interrupts the operation of the conveyor 190. Then, the silverware rack is removed from the tray washing system 20 through a door 219, and the silverware is removed from the rack and is positioned as necessary for use in the next meal. Thus, the tray washing system 20 functions not only to wash compartmented food service trays, but also the silverware that is used in conjunction with the trays in serving a meal.

In the operation of the portion of the tray washing system 20 shown in FIG. 7, washing and rinsing fluids are sprayed onto each tray and are subsequently stripped therefrom. In accordance with the preferred embodiment, the spent washing and rinsing fluids are not discarded. Instead, the runoff from the rinsing mechanism 30 and the runoff from the washing mechanism 28 are combined with a portion of the output of the refuse receiving mechanism 124 to form the cleaning fluid that is employed in the scrapping mechanism 26. In this manner, the cost of operating the tray washing system is greatly reduced in that both water costs and water heating costs are held to an absolute minimum.

Figure 9:
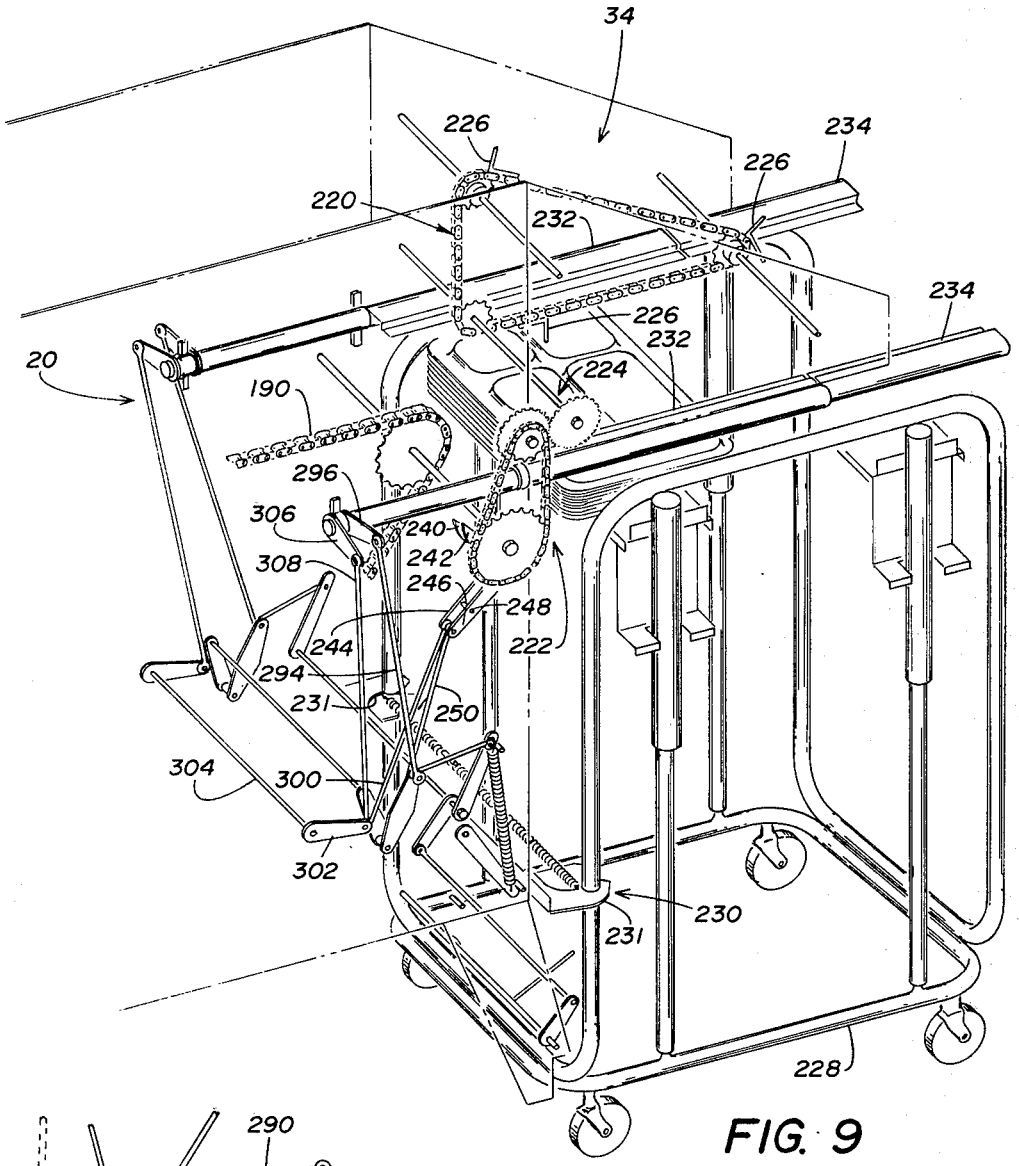
FIG. 9 is a perspective view showing the tray stacking mechanism of the tray washing system.
Figure 10:
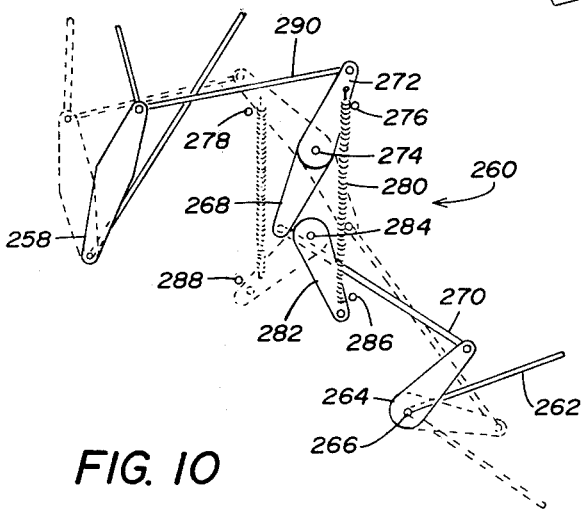
FIG. 10 is an enlarged side view of a portion of the mechanism shown in FIG. 9.
Figure 11:
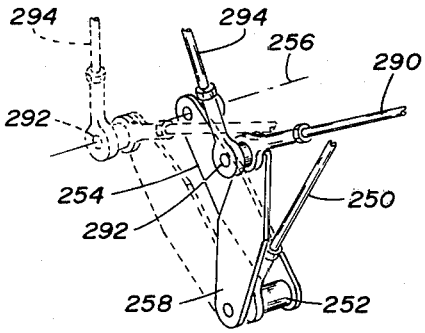
FIG. 11 is a perspective view of a portion of the mechanisms shown in FIG. 10, and FIGS. 12 and 13 are top and side views, respectively, of the operating portions of the tray washing system.

Referring now to FIGS. 9, 10 and 11, the conveyor 190 drives a pin type conveyor 220 through a chain and sprocket drive mechanism 222 and a pair of gears 224. Each tray passing through the tray washing system 20 is transported by the conveyor 190 into engagement with the conveyor 220, whereupon the tray is engaged by a pin 226 projecting from the conveyor 220 and is transported into the tray stacking mechanism 34 of the tray washing system 20. The stacking mechanism 34 in turn stacks the trays on a conventional mobile self-depressing tray receiver 228. The self-depressing tray receiver illustrated in FIG. 9 is conventional in design in that it receives two parallel stacks of trays each comprising trays stacked upside down and one on top of another. This is advantageous in that the trays are not contaminated by dirt, etc. while they are in the tray receiver.

The self-depressing tray receiver 228 is secured to the tray washing system 20 by a latch mechanism 230. The latch mechanism 230 comprises a pair of spring loaded latches 231 which are arranged to prevent either the engagement or the disengagement of a tray receiver with the latch mechanism 230 by a straight line movement. Instead, the latch mechanism 230 requires a pivoting motion in first one direction and then the other relative to a line extending along the conveyors 190 and 220 in order to latch or unlatch a tray receiver. In this manner, the latch mechanism 230 retains the tray receiver in the position shown in FIG. 9 unless it is intentionally removed.

The tray stacking mechanism 34 comprises a pair of inner opposed tray stacking ledges 232 and a pair of outer opposed tray stacking ledges 234. In use, both pairs of tray stacking ledges are initially pivoted between the tray receiving position illustrated in FIG. 9 and a tray depositing position in timed relationship to the movement of trays into the tray stacking mechanism 34. Since the ledges 232 are positioned closer to the conveyor 190, the stacking mechanism 34 initially forms an inner stack of trays in the self-depressing tray receiver 228.

When the inner stack has been completed, the stacking mechanism 34 automatically discontinues the reciprocation of the tray stacking ledges 232 and retains the tray stacking ledges 232 in the horizontal position illustrated in FIG. 9. Thereafter, the conveyor 220 advances each tray passing through the tray washing system 20 across the inner tray stacking ledges 232 and onto the ledges 234. The ledges 234 are pivoted from the tray receiving position to the tray depositing position throughout the operation of the stacking mechanism 34, so that after it has formed an inner stack of trays, the stacking mechanism 34 forms an outer stack of trays in the tray receiver 228. When the outer stack has been completed, a limit switch (not shown) is actuated, whereupon the operation of the tray washing system 20 is discontinued.

More specifically, the conveyor 190 drives the tray stacking mechanism 34 through a pair of cams 240 and 242. The cams 240 and 242 are mounted for rotation by the conveyor 190 into engagement with a pair of levers 244 and 246, respectively, each of which is supported for pivotal movement about a pin 248. Thus, during each operating cycle of the tray washing system 20, the cams 240 and 242 engage the levers 244 and 246, respectively and pivot the levers about the pin 248.

The lever 244 is connected to a link 250. As is best shown in FIG. 11, the link 250 is in turn connected to a pin 252 that is mounted on a lever 254 for rotation about an axis 256. Thus, each time the lever 244 is rocked by the cam 240, the pin 252 is moved arcuately about the axis 256. A lever 258 is supported on the pin 252 for actuation by the cam 240 and the lever 244 through the link 250. However, the effect of the actuation of the lever 258 is controlled by a tray responsive control mechanism 260.

As is best shown in FIG. 10, the tray responsive control mechanism 260 includes a tray sensing pin 262 which is positioned in the path of the inner stack of trays in the tray receiver 228. A lever 264 is connected to the pin 262 for pivotal movement therewth about a shaft 266. The lever 264 is connected to a lever 268 through a link 270, and the lever 268 is connected to a lever 272 for pivotal movement about a pivot 274.

The lever 272 is supported on the pivot 274 for movement between extreme positions which are defined by a pair of pins 276 and 278. A spring 280 extends between the lever 272 and a lever 282 which is supported on a pivot 284 for movement between extreme positions defined by a pair of pins 286 and 288. Thus, the levers 272 and 282 and the spring 280 comprise an overcentering toggle mechanism which is constrained to occupy either the position shown in full lines in FIG. 10 or the position shown in dashed lines therein.

As is shown in FIGS. 10 and 11, the lever 272 is connected to a link 290, and the link 290 is connected to a pin 292 that is secured to the upper end of the lever 258. As is shown in FIG. 9 and 11, a link 294 extends from the pin 292 to a lever 296. The lever 296 in turn controls the rotational position of one of the inner tray stacking ledges 232. A mechanism identical in construction and operation to that comprising the parts 252 through 296 is employed on the remote side of the tray stacking mechanism 34 to control the rotational position of the other inner stacking ledges 232. Since the cam 240 is operated by the conveyor 190, it will be understood that whenever the tray sensing pin 262 is positioned as shown in full lines in FIG. 10, the mechanism shown in FIGS. 10 and 11 and the corresponding mechanism located on the remote side of the tray stacking mechanism 34 cooperate to deposit each tray passing through the tray washing system 20 onto the inner stack of trays in the mobile self-depressing tray receiver 228.

When a predetermined number of trays have been deposited on the inner stack of the receiver 228, the stack is depressed to such an extent that it engages the tray sensing pin 262 of the mechanism 260. The pin 262 is thereupon rotated about the pivot 266, which in turn rocks the lever 268 about the pivot 284. Sufficient pivoting of the lever 268 snaps the mechanism 260 overcenter, whereupon the spring 290 drives the levers 272 and 282 into the position shown in dashed lines in FIG. 10. Since the link 290 is connected to the pin 292 which is in turn connected to the upper end of the lever 258, movement of the mechanism 260 into the position shown in dashed lines in FIG. 10 positions the lever 258 as shown in dashed lines in FIG. 11.

Assuming now that the cam 240 engages the lever 246 while the component parts of the mechanism 260 are positioned as shown in dashed lines, the pin 252 is again moved arcuately about the axis 256 by the link 250. However, the mechanism 260 now retains the pin 292 in alignment with the axis 256. Thus, both the lever 254 and the lever 258 pivot arcuately about the axis 256, with no resulting upward motion being imposed on the link 294. The lever 296 is therefore retained in the position shown in FIG. 9, as is the tray stacking ledge 232 that is connected to the lever 296. It will be understood that the corresponding mechanism located on the remote side of the tray stacking mechanism 34 operates similarly to retain the other tray stacking ledge 232 in the tray receiving position.

The lever 246 is connected to a link 300 which is in turn connected to a lever 302. The lever 302 is supported for pivotal movement about the axis of a shaft 304, and is connected to a lever 306 by a link 308. The lever 306 controls the rotational position of one of the outer tray stacking ledges 234, and a similar mechanism located on the remote side of the tray stacking mechanism 34 controls the rotational position of the other ledge 234. Thus, each time the lever 246 is pivoted by the cam 242, the ledges 234 are pivoted downwardly. This action occurs regardless of whether the inner stack on the tray receiver 228 is full, but it is effective only after the pin 262 has been actuated to position the mechanism 260 as shown in dashed lines in FIG. 10. Thereafter, the conveyor 220 transports trays across the inner stack of trays on the tray receiver 228 and onto the outer pair of opposed tray ledges 234. Then, the ledges 234 are rotated to form an outer stack of trays in the tray receiver 228.

When the outer stack in the mobile self-depressing tray receiver is full, a limit switch (not shown) is actuated, whereupon the operation of the tray washing system 20 is stopped. Then, the tray receiver 228 is removed from the position shown and is replaced by another, similar device. The tray sensing pin 262 of the tray responsive control mechanism is so positioned that it is returned to the position shown in full lines in FIG. 10 whenever a tray receiver is removed from the tray washing system 20. In this manner, the system is returned to its original condition.

OPERATION

Figure 12:
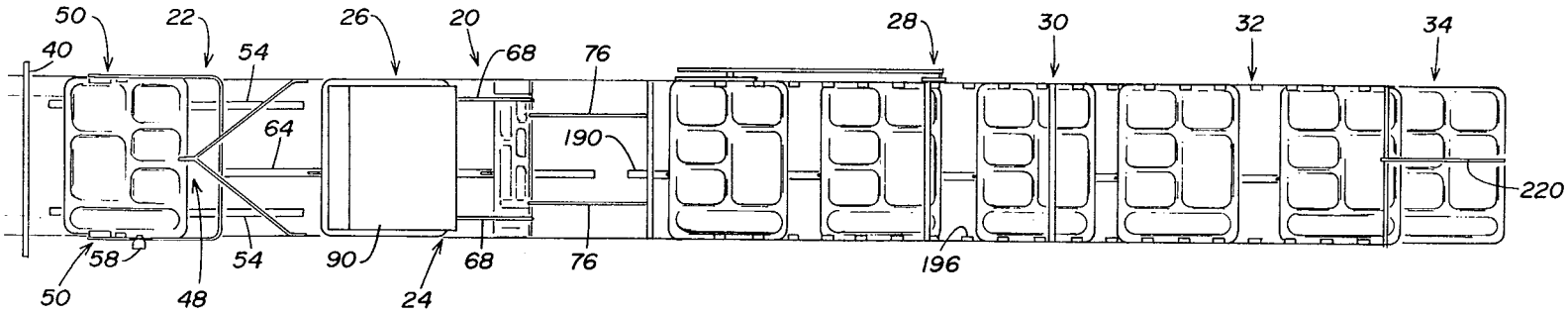
Figure 13:
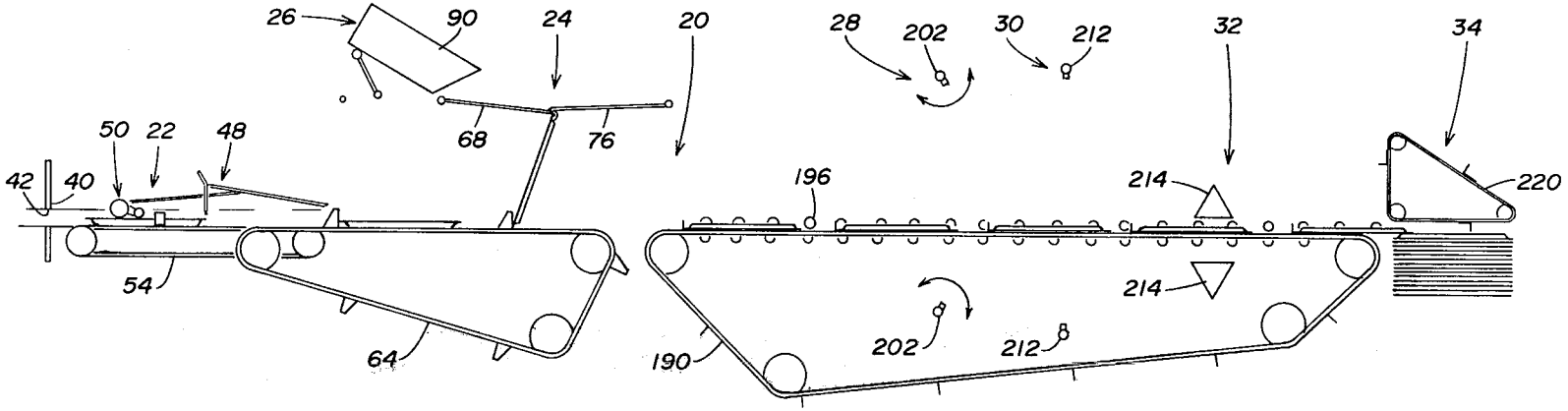

The operation of the tray washing system 20 in cleaning compartmented food service trays is best illustrated in FIGS. 12 and 13. At the conclusion of his meal, each student inserts his tray through the passageway 42 of the plate 40 with the food receiving surface of the tray facing upwardly and with the silverware receiving compartment positioned to the right. The tray engages the rollers 50, whereupon the blocking member 48 is pivoted out of the path of the tray. Upon insertion through the passageway 42, the tray is engaged by the conveyor 54, and is advanced by the conveyor into engagement with the tray spacer member 58. At the proper point in the next cycle of the tray washing mechanism 20, the spacer 58 releases the tray for movement by the conveyor 54 into engagement with the conveyor 64.

The conveyor 64 advances the tray to the tray inverting mechanism 24 which initially pivots the tray into a vertical orientation. At this point, the scrapping mechanism 26 dumps substantially the entire contents of the reservoir 90 onto the food receiving surface of each tray, and thereby dislodges refuse and any silverware that may be on the tray. After the scrapping action, the tray inverting mechanism 24 continues the inversion of the tray, so that the tray passes through the remainder of the tray washing system 20 in an inverted orientation.

The tray inverting mechanism 24 delivers the tray to the conveyor 190 which transports the tray through the washing mechanism 28, the rinsing mechanism 30, and the drying mechanism 32 of the tray washing system 20. During its movement, the tray is constrained by the opposed rollers 196 which prevent fluttering of the tray due to the spraying actions of the washing, rinsing and the drying mechanisms.

Upon leaving the drying mechanism 32, the tray is transported by the conveyor 190 and the conveyor 220 to the tray stacking mechanism 34. The stacking mechanism 34 forms inner and outer stacks of the trays on a conventional mobile, self-depressing tray receiver 228. When the receiver 228 is full, it is disengaged from the tray washing system 20, and is thereafter employed to dispense trays during a subsequent meal.

Preferably, each student deposits his silverware in the silverware chute 130. Any silverware remaining on a compartmented food service tray is dislodged during the scrapping of the tray, and comes to rest in engagement with the dam 136. In either event, all of the silverware that is used in a particular meal ultimately comes to rest in the silverware soaking sink 134.

After all of the trays from a meal have been washed, the silverware from the meal is removed from the sink 134 by lifting the silverware basket therefrom and is placed in a silverware rack. The silverware rack is then inserted through the door 216 for transportation through the washing and rinsing of the tray washing system 20. After the silverware rack has passed through the rinsing mechanism, it is removed through the door 219, and the silverware is removed from the rack for use in the next meal.

Those skilled in the art will immediately appreciate the fact that compartmented food service trays are useful in serving meals at institutions other than elementary schools, for example, summer camps, military bases, prisons, etc. Obviously, the present invention is adapted for use at any of these institutions, and is not limited to use at elementary schools. Also, the present invention is not limited to use with the particular compartmented food service tray shown in FIG. 1. Quite to the contrary, the invention is easily modified for use with any of the compartmented food service trays that are presently on the market. Finally, various features of the present invention are readily adaptable to the cleaning of tableware items other than compartmented food service trays.

From the foregoing, it will be understood that the present invention comprises a fully automated system for cleaning compartmented food service trays. In accordance with the preferred embodiment of the invention, each tray is inverted from an initial orientation in which the food receiving surface of the tray, through a vertical orientation, to a horizontal orientation in which the food receiving surface faces downwardly. While the tray is oriented vertically, a cleaning fluid is poured over the tray to dislodge refuse and silverware from the tray. After it is inverted, the tray is washed, rinsed and dried. Finally, the tray is stacked on a mobile self-depressing tray receiver. The use of the invention is advantageous in that it completely eliminates the manual labor that has heretofore been necessary to the cleaning of compartmented food service trays.

Although the preferred embodiment of the invention has been illustrated in the drawings and described in the foregoing specification, it will be understood that the invention is not limited to the embodiment disclosed, but is capable of rearrangement, modification and substitution of parts and elements without departing from the spirit of the invention.

What is claimed is:

1. In a tray cleaning system, a tray inverting mechanism comprising:

means for moving a tray along a predetermined path;

at least one rigid arm supported for pivotal movement about a horizontal axis and for cooperation with the moving means to pivot the tray from a first orientation wherein the food receiving surface of the tray faces upwardly to a second orientation wherein the food receiving surface extends vertically;

at least one second rigid arm pivotally supported for pivoting the tray from the second orientation to a third orientation wherein the food receiving surface faces downwardly; and drive means including a source of rotational motion and lever means drivingly interconnecting the source of rotational motion and the second arm for pivoting the second pivotally supported arm into engagement with the tray when the tray is in the second orientation.

2. In a tray cleaning system, a tray inverting mechanism comprising:

means for moving a tray along a predetermined path;

first pivotally supported arm means for cooperation with the moving means to pivot the tray from a first orientation wherein the food receiving surface of the tray faces upwardly to a second orientation wherein the food receiving surface extends vertically;

a second pivotally supported arm for pivoting the tray from the second orientation to a third orientation wherein the food receiving surface faces downwardly;

means for pivoting the second pivotally supported arm into engagement with the tray when the tray is in the second orientation;

said second pivotally supported arm being mounted for pivotal movement about the axis extending transversely of the path, and means mounted for movement with the second pivotally supported arm for gripping the tray in engagement with the second pivotally supported arm.

3. The tray inverting mechanism according to claim 2 further including timing means for coordinating the movement of the secondly pivotally supported arm into engagement with the tray with the movement of the tray to the second orientation under the action of the moving means and the first pivotally supported arm.

4. The tray inverting mechanism according to claim 1 further including a cleaning fluid reservoir and means for dumping substantially the entire contents of the reservoir onto the tray while it is in the second orientation.

* * * * *

UNITED STATES PATENT OFFICE
CERTIFICATE OF CORRECTION

Patent No. 3,939,854 Dated February 24, 1976

Inventor(s) Lawrence Pete Kitterman et al

It is certified that error appears in the above-identified patent and that said Letters Patent are hereby corrected as shown below:

Column 4, line 3, after "shape" insert -- tray --.

Column 8, line 6,after "rinsing" insert -- fluid that was applied to the trays by the rinsing --.

Column 9,line 65, "therewth" should be -- therewith --.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*